US011047617B1

(12) United States Patent
Bassler et al.

(10) Patent No.: US 11,047,617 B1
(45) Date of Patent: Jun. 29, 2021

(54) SHELF ASSEMBLY WITH SPECIFIC CARRIER FRAME, AND HOUSEHOLD COOLING APPLIANCE WITH A SHELF ASSEMBLY

(71) Applicant: BSH HAUSGERAETE GMBH, Munich (DE)

(72) Inventors: Daniel Bassler, Aalen (DE); Cetin Abdullah Celik, Knoxville, TN (US); Andrea Fink, Gerstetten (DE); Felix Haenssler, Langenau (DE); Christian Legner, Koenigsbronn (DE); Thomas Wykydal, Sontheim (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/789,688

(22) Filed: Feb. 13, 2020

(51) Int. Cl.
*F25D 25/02* (2006.01)

(52) U.S. Cl.
CPC ..... *F25D 25/024* (2013.01); *F25D 25/02* (2013.01); *F25D 2325/021* (2013.01)

(58) Field of Classification Search
CPC .. F25D 25/024; F25D 25/02; F25D 2325/021; A47B 96/025
See application file for complete search history.

(56) References Cited

U.S. PATENT DOCUMENTS 3,633,983 A * 1/1972 Whitcomb ..... F25D 25/024 312/306
8,403,438 B2 * 3/2013 Park ..... F25D 25/02 312/408
8,777,341 B2 * 7/2014 Amaral ..... F25D 25/024 312/408
8,840,205 B2 * 9/2014 Chellappan ..... F25D 23/067 312/408
8,979,225 B2 * 3/2015 Eckartsberg ..... A47B 57/42 312/408
9,103,582 B2 * 8/2015 Nash ..... B23P 19/04
9,127,877 B2 * 9/2015 Lee ..... F25D 25/024
9,335,089 B1 * 5/2016 Gossens ..... A47B 96/025
9,453,673 B2 * 9/2016 Gossens ..... A47B 96/025
9,459,040 B2 * 10/2016 Kim ..... F25D 25/02
9,574,820 B2 * 2/2017 Lee ..... A47B 45/00
10,670,327 B1 * 6/2020 Haenssler ..... F25D 23/067
10,753,674 B1 * 8/2020 Brzezina ..... F25D 25/024
2010/0001625 A1 * 1/2010 Eckartsberg ..... F25D 23/067 312/408
2011/0001415 A1 * 1/2011 Park ..... F25D 25/02 312/408
2012/0091084 A1 * 4/2012 Amaral ..... F25D 25/024 211/80

(Continued)

*Primary Examiner* — Kimberley S Wright

(74) *Attorney, Agent, or Firm* — Laurence A. Greenberg; Werner H. Sterner; Ralph E. Locher

(57) ABSTRACT

A shelf assembly for installation in a household cooling appliance includes a first shelf and a second shelf that is separate from the first shelf. A carrier frame supports the first shelf and the second shelf. The carrier frame has a guiding. At least one of the shelves can be shifted relative to the carrier frame and relative to the other shelf by way of the guiding. The carrier frame has a first side bar with a holding bracket for holding the shelf assembly at a component of the household cooling appliance. The first side bar has a channel-like housing, into which the holding bracket is introduced.

14 Claims, 7 Drawing Sheets

(56) References Cited

U.S. PATENT DOCUMENTS

| | | | | |
|---|---|---|---|---|
| 2014/0239792 | A1* | 8/2014 | Chellappan | A47B 96/025 312/408 |
| 2014/0375199 | A1* | 12/2014 | Lee | F25D 25/024 312/404 |
| 2015/0153099 | A1* | 6/2015 | Nash | F25D 25/024 312/408 |
| 2015/0253064 | A1* | 9/2015 | Kim | F25D 25/024 312/408 |
| 2016/0238307 | A1* | 8/2016 | Lee | F25D 25/027 |
| 2020/0182536 | A1* | 6/2020 | Haenssler | F25D 11/00 |
| 2020/0263920 | A1* | 8/2020 | Brzezina | F25D 25/024 |
| 2020/0340737 | A1* | 10/2020 | Brzezina | F25D 25/024 |

* cited by examiner

SHELF ASSEMBLY WITH SPECIFIC CARRIER FRAME, AND HOUSEHOLD COOLING APPLIANCE WITH A SHELF ASSEMBLY

BACKGROUND OF THE INVENTION

Field of the Invention

An aspect of the invention relates to a shelf assembly for a household cooling appliance. A further aspect of the invention relates to a household cooling appliance.

U.S. Pat. No. 9,103,582 B2 discloses a shelf assembly. That assembly comprises two glass plates, which are each surrounded by a frame. The two plates are shiftable relative to each other in depth direction of the assembly. Moreover, the assembly comprises a frame, by which these two plates are held. However, the frame only extends over the length of the rear plate with its side bars. The front plate is protruding forwards beyond the side bars in a use position. In this respect, the front plate freely cantilevers at the front. Thereby, this front plate is severely loaded in the use position. Large leverage forces act on the mechanical connection of this front plate to the frame. Moreover, it is provided in this known configuration of the assembly that holding brackets are a constituent of this carrying frame. However, these holding brackets are arranged virtually completely exposed. Thereby, functional impairments can result. Moreover, the attachment to and mounting on the remaining components of the carrying frame are restricted. The entire mechanical stability of the carrying frame is thereby reduced.

A shelf assembly is also known from U.S. Pat. No. 9,127,877 B2. There too, two separate shelves are provided. One of these two shelves is movably arranged on a carrying frame of this assembly. The front, movable shelf comprises laterally protruding pins. These pins serve for coupling to a guiding formed at the carrying frame. Both in the rear area of this front shelf and in the front area, correspondingly protruding pins are respectively formed. By such a configuration, jamming or strutting can result upon shifting this front plate. In particular if the plate does not perform a completely rectilinear movement in depth direction, but performs an S-like movement in this respect. Moreover, it is prevented by this configuration that the front plate is separated from the carrying frame at the front end in its use position. In this configuration too, it is provided that holding brackets of the carrying frame are arranged relatively exposed. Therefore, the disadvantages already mentioned to the above mentioned prior art apply here too in this respect.

Furthermore, from U.S. Pat. No. 8,840,205 B2 a shelf assembly is known. The construction is corresponding as in U.S. Pat. No. 9,127,877 B2 with respect to the essential aspects and the disadvantages already mentioned above.

BRIEF SUMMARY OF THE INVENTION

It is an object of the present invention to provide a shelf assembly, in which the carrier frame is improved. In particular, it is an object to more stably configure this carrier frame. It is an object to position holding brackets of the carrier frame in improved manner. In this respect, the stability of these holding brackets in particular is to be improved.

It is an object of the invention to improve the operability of a shelf of the shelf assembly. The operability in this respect is to be improved for a movable shelf of this shelf assembly. In particular, it is an object to be able to more smoothly shift a movable shelf of the shelf assembly. Jammings and struttings of this movable shelf upon shifting at least are to be reduced. It is an object of the present invention to provide a movable shelf of the shelf assembly, which allows certain movability with respect to the carrier frame in the use position.

It is a further object of the present invention to provide a household cooling appliance with such a shelf assembly.

These objects are solved by a shelf assembly and a household cooling appliance according to the independent claims.

An aspect of the invention relates to a shelf assembly for installation in a household cooling appliance, comprising:

a first shelf, a second shelf, which is separate from the first shelf, a carrier frame, at which the first shelf and the second shelf are arranged, wherein the carrier frame comprises a guiding, and at least one of the shelves can be shifted relative to the carrier frame and to the other shelf by the guiding, wherein the carrier frame comprises a first side bar, wherein the first side bar comprises a holding bracket for holding the shelf assembly at a household cooling appliance component and the first side bar comprises a channel-like housing, into which the holding bracket is introduced.

A further aspect of the invention relates to a household cooling appliance comprising:

a housing, a receiving space for food, which is arranged in the housing, a shelf assembly, which is arranged in the receiving space, wherein the shelf assembly comprises:

a first shelf, a second shelf, which is separate from the first shelf, a carrier frame, at which the first shelf and the second shelf are arranged, wherein the carrier frame comprises a guiding, and at least one of the shelves can be shifted relative to the carrier frame and to the other shelf by the guiding, wherein the carrier frame comprises a first side bar, wherein the first side bar comprises a holding bracket for holding the shelf assembly at a household cooling appliance component and the first side bar comprises a channel-like housing, into which the holding bracket is introduced.

Further features of the invention are apparent from the claims, the figures and the description of figures. The features and feature combinations mentioned above in the description as well as the features and feature combinations mentioned below in the description of figures and/or shown in the figures alone are usable not only in the respectively specified combination, but also in other combinations without departing from the scope of the invention. Thus, implementations are also to be considered as encompassed and disclosed by the invention, which are not explicitly shown in the figures and explained, but arise from and can be generated by separated feature combinations from the explained implementations. Implementations and feature combinations are also to be considered as disclosed, which thus do not comprise all of the features of an originally formulated independent claim. Moreover, implementations and feature combinations are to be considered as disclosed, in particular by the implementations set out above, which extend beyond or deviate from the feature combinations set out in the back-references of the claims.

Below, embodiments of the invention are explained in more detail based on schematic drawings.

BRIEF DESCRIPTION OF THE SEVERAL VIEWS OF THE DRAWING

In the figures, identical or functionally identical parts are provided with the same reference signs.

DETAILED DESCRIPTION OF THE INVENTION

With indications of "top", "bottom", "front", "rear", "horizontal", "vertical", "depth direction", "width direction", "height direction", etc., the positions and orientations given in intended use and intended arrangement of the apparatus are specified.

Figure 1:
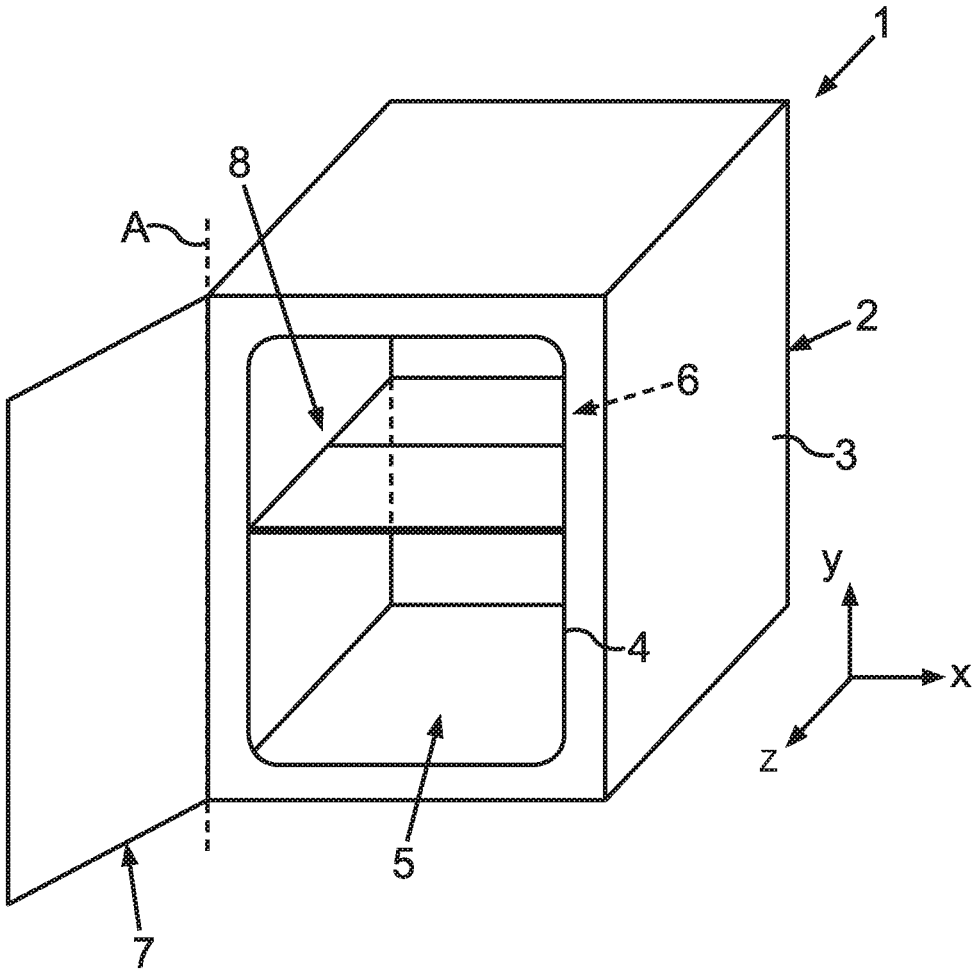
FIG. 1 is a schematic perspective representation of an embodiment of a household cooling appliance according to the invention with a schematic representation of an embodiment of a shelf assembly according to the invention.

Referring now to the figures of the drawing in detail and first, particularly, to FIG. 1 thereof, there is shown a household cooling appliance 1 in a simplified representation. The household cooling appliance 1 is formed for storing and preserving food. The household cooling appliance 1 can for example be a cooling appliance or a freezing appliance or a fridge-freezing appliance. The household cooling appliance 1 comprises a housing 2. In an embodiment, the housing 2 comprises an outer housing 3. Moreover, the housing 2 comprises an inner liner 4. The inner liner 4 is received in the outer housing 3. The inner liner 4 is separate from the outer housing 3.

In an embodiment, the household cooling appliance 1 comprises at least one receiving space 5 for food. Multiple separate receiving spaces can also be provided. In an embodiment, the receiving space 5 can be a cooling compartment. The receiving space 5 is bounded by walls of the inner liner 4.

In an embodiment, a thermally insulating material is arranged in a clearance 6 between the outer housing 3 and the inner liner 4.

In an embodiment, the household cooling appliance 1 comprises a door 7. In the shown embodiment, the door 7 is movably arranged at the housing 2. In an embodiment, the door 7 is pivotable around an axis A oriented in vertical direction (y-direction). The receiving space 5 is closable on the front side by the door 7.

Moreover, an embodiment of a shelf assembly 8 is shown in a schematic representation in FIG. 1. The shelf assembly 8 is illustrated in its final position in the receiving space 5 in FIG. 1. The shelf assembly 8 can be removed from the receiving space 5 in non-destructively detachable manner. As is apparent, the shelf assembly 8 extends across the entire width of the receiving space 5. This width is measured in width direction (x-direction) of the household cooling appliance 1.

In an embodiment, it is provided that the shelf assembly 8 extends over at least 50 percent of the depth of the receiving space 5. The depth is measured in depth direction (z-direction) of the household cooling appliance 1. In an embodiment, this shelf assembly 8 extends over at least 60 percent, in particular at least 70 percent, in particular at least 80 percent, in particular at least 90 percent of this depth of the receiving space 5.

In an embodiment, it can be provided that the shelf assembly 8 can be arranged at different discrete levels in the receiving space 5.

The shelf assembly 8 can be used as a compartment divider or compartment shelf. In an embodiment, the shelf assembly 8 also serves for depositing storage goods. Such storage goods are food like beverages or meal.

Figure 2:
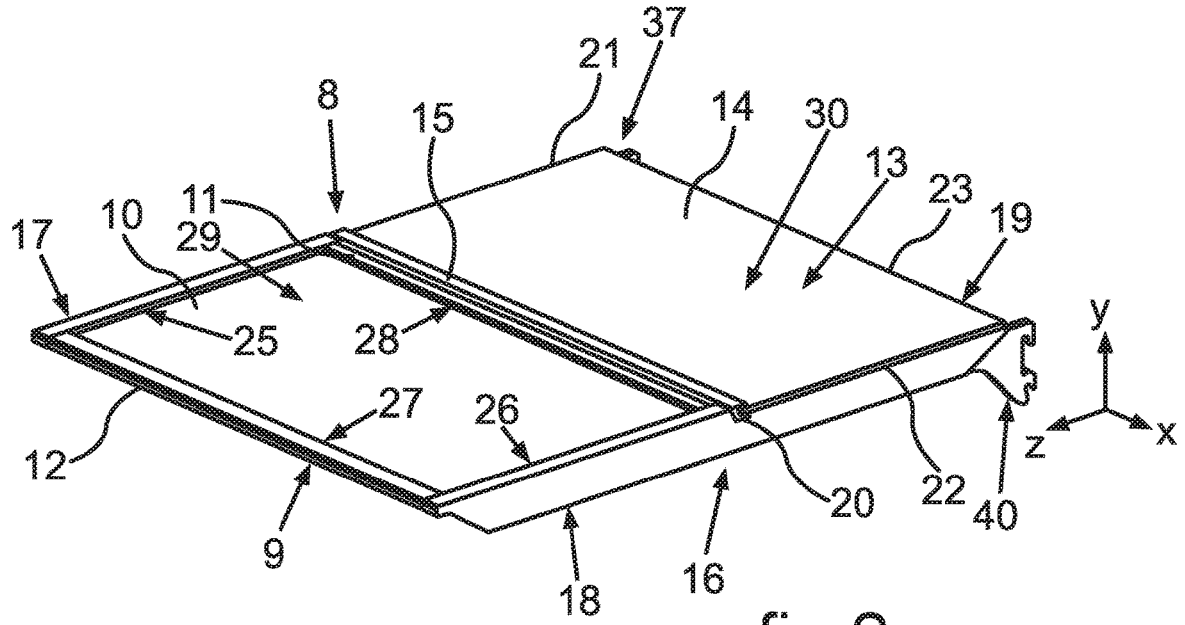
FIG. 2 is a perspective representation of an embodiment of a shelf assembly in a use position of two shelves of this shelf assembly.

In FIG. 2, an embodiment of a shelf assembly 8 is shown in a perspective representation. The shelf assembly 8 comprises a first shelf 9. The first shelf 9 comprises a base plate 10. The base plate 10 can for example be of glass. However, it can for example also be of plastic. The base plate 10 is quadrangular in the embodiment. In particular, it is rectangular. In the embodiment, the first shelf 9 comprises a rear edge profile 11. The designation with respect to the rear edge profile 11 relates to the position at the first shelf 9 to other components of the first shelf 9 viewed in depth direction. This rear edge profile 11 is a rectilinear ledge. It is in particular C-shaped or U-shaped in cross-section. In an embodiment, the edge profile 11 is formed without interruption. In an embodiment, the rear edge profile 11 extends across the entire width of the base plate 10. This width is measured in width direction. The rear edge profile 11 is a component separate from the base plate 10 in an embodiment.

In an embodiment, the first shelf 9 comprises a front edge profile 12. The front edge profile 12 is formed as a rectilinear ledge. It can be U-shaped or C-shaped in cross-section. In an embodiment, the front edge profile 12 is formed as a respectively separate component from the base plate 10 like the rear edge profile 11. In an embodiment, the rear edge profile 10 can be fitted to the base plate 10. In an embodiment, the front edge profile 12 can be fitted to the base plate 10. In an embodiment, the rear edge profile 11 can be integrally formed of plastic. However, it can for example also be formed of metal. The front edge profile 12 can be integrally formed of plastic in an embodiment. However, it can also be formed of metal.

In an embodiment, this shelf assembly 8 comprises a second shelf 13. The second shelf 13 is formed separate from the first shelf 9 in an embodiment. In an embodiment, the second shelf 13 comprises a base plate 14. The base plate 14 is for example formed of glass. However, it can also be formed of plastic. Similarly as the base plate 10, the base plate 14 can also be formed transparent at least in certain areas in an embodiment.

In an embodiment, the second shelf 13 can comprise a front edge profile 15. In an embodiment, the front edge profile 15 is separate from the base plate 14. In an embodiment, the front edge profile 15 extends across the entire width of the base plate 14. The front edge profile 15 can be C-shaped or U-shaped in cross-section. In an embodiment, the front edge profile 15 is arranged at a front edge of the base plate 14. It can be fitted thereto.

In an embodiment, the shelf assembly 8 comprises a carrier frame 16. The carrier frame 16 is separate from the first shelf 9 and separate from the second shelf 13. In an embodiment, the carrier frame 16 is U-shaped formed. In an embodiment, it comprises a first side bar 17. Moreover, it comprises a second side bar 18. The two side bars 17 and 18 extend in depth direction. The two side bars 17 and 18 are arranged parallel and spaced from each other. The two side bars 17 and 18 extend in depth direction. They are straight and bar-like.

Moreover, the carrier frame 16 comprises a connecting bar 19. It connects the two side bars 17 and 18.

In an embodiment, the second shelf 13 is the rear shelf in depth direction. This second shelf 13 is fixedly attached to the carrier frame 16 in an embodiment. In an embodiment, it can for example be adhered to the carrier frame 16. In the shown embodiment, only a front edge 20 of the base plate 14 is provided with such a front edge profile 15. Side edges 21 and 22 of the base plate 14 are not provided with further such separate edge profiles in the shown embodiment. Moreover, a rear edge 23 of the base plate 14 is not provided with such an edge profile in the shown embodiment.

In an embodiment, it is provided that the base plate 14 and thus the second shelf 13 have a width, which exactly corresponds to the distance between the two side bars 17 and 18. Thereby, a lateral protrusion of the second shelf 13 viewed in width direction beyond these side bars 17 and 18 is avoided. In particular, the side edges 21 and 22 are arranged aligned to the outer sides of the side bars 17 and 18.

Figure 3:
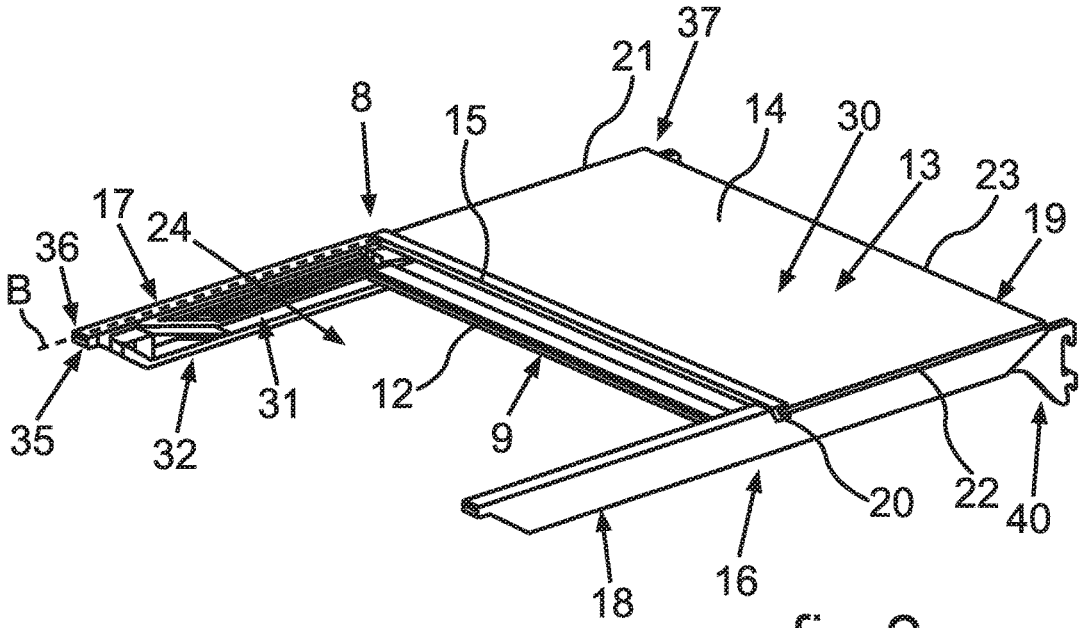
FIG. 3 is the representation of the shelf assembly according to FIG. 2 in a stowage position of one of the two shelves.

In FIG. 2, a use position of the shelves 9 and 13 is shown. This means that the two shelves 9 and 13 are arranged one behind the other and in series to each other in depth direction. Thereby, a maximum entire shelf area of the shelf assembly 8 is formed. In an embodiment, the first shelf 9 is arranged movable to the second shelf 13. In the state, in which it is arranged at the carrier frame 16, it can be shifted relative to the second shelf 13 at the carrier frame 16. In an embodiment, thereto, it can be shifted rearwards and below the second shelf 13 starting from the use position shown in FIG. 2. This is shown in FIG. 3. Thus, a non-use position of the first shelf 9 is shown there. It can be provided that the first shelf 9 can be positioned completely below the second shelf 13 viewed in depth direction. Thereby, a free space is formed between the side bars 17 and 18 in the non-use position of the shelf 9 shown in FIG. 3. Thereby, storage goods can be positioned in the receiving space 5 below the shelf assembly 8, but which nevertheless extend into this free space 24, as it is shown in FIG. 3, in vertical direction. Thereby, storage goods can also be positioned such that they can virtually extend upwards through the shelf assembly 8.

In the embodiment according to FIG. 2 and FIG. 3, it is provided that side edges 25 and 26 of the base plate 10 of the first shelf 9 are formed without a frame fixedly arranged thereon. Thus, edge profiles are in particular not arranged at these side edges 25 and 26. In the shown embodiment, thus, only the front edge 27 is provided with the front edge profile 12 and a rear edge 28 in the rear edge profile 11.

Moreover, it is apparent that the first shelf 9 is narrower in width direction than the second shelf 13 in an embodiment. In an embodiment, the first shelf 9 is arranged flush with a top face 30 of the second shelf 13 with a top face 29 when the use position of the shelves 9 and 13 shown in FIG. 2 is set.

Figure 4:
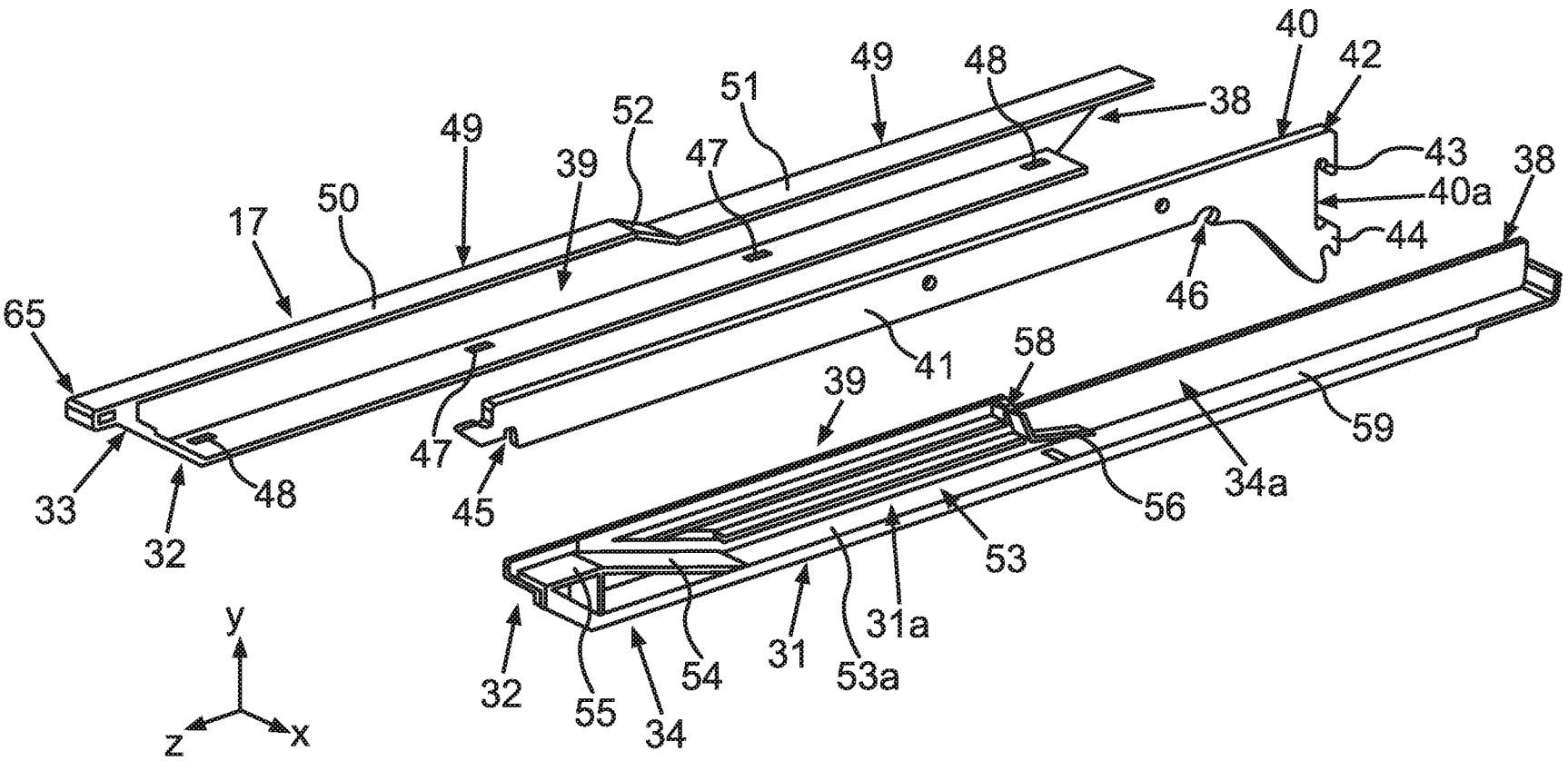
FIG. 4 is an exploded representation of partial components of a carrier frame of the shelf assembly according to FIG. 2 and FIG. 3.

In FIG. 3, an embodiment is shown, in which a guide assembly or guide 31, referred to herein as a guiding 31, is also illustrated. In an embodiment, the guiding 31 is arranged at the first side bar 17 as well as at the second side bar 18. Thereto, the guiding 31 comprises a first guiding part 31*a* (FIG. 4). It is arranged at the first side bar 17. A second guiding part of the guiding 31 is arranged at the second side bar 18. The movably supported first shelf 9 can be guided in defined manner by the guiding 31. In this context, it can be shifted in depth direction.

In FIG. 4, the first side bar 17 of the carrier frame 16 is shown in an exploded representation. The first side bar 17 comprises a housing 32. In the shown embodiment, the housing 32 comprises a first housing part 33. Moreover, it comprises a second housing part 34 separate from the first housing part 33. The two housing parts 33 and 34 are elongated components. In an embodiment, they are each integrally formed. In this respect, they can for example be formed of plastic. The first guiding part 31*a* is arranged on an outer side 34*a* of the second housing part 34. The two housing parts 33 and 34 are connected by a connection 35 (FIG. 3). In particular, this connection 35 is a mechanical connection. It can for example be a snap-fit connection.

In FIG. 3, these two housing parts 33 and 34 are shown in the mounted final position. Thereby, they form the housing 32. In this mounted final position, the housing 32 is such that it is closed at a front end 36 in the direction of its length axis B (FIG. 3). In circumferential direction around the length axis B, the housing 32 is also completely closed. The housing 32 is open at a rear end 37. In this respect, it comprises an opening 38. In the assembled state of the two housing parts 33 and 34, a hollow space 39 is formed in the interior of the housing 32. This hollow space 39 is provided for receiving a separate holding bracket 40 as it is shown in FIG. 4. In an embodiment, the holding bracket 40 is integrally formed. For example, it can be formed of metal. The holding bracket 40 is sword-like formed in an embodiment. In this respect, it comprises an elongated, strip-shaped bracket part 41. This bracket part 41 is introduced, in particular completely introduced, into the hollow space 31 in the mounted final state. In an embodiment, the holding bracket 40 comprises an end piece 42. This end piece 42 is a rear end 40*a* of the holding bracket 40. This end piece 42 is thickened with respect to the bracket part 41. In an embodiment, the end piece 42 comprises holding hooks 43 and 44. The shelf assembly 8 can be detachably attached to a household appliance component of the household cooling appliance 1 by these holding hooks 43 and 44. In particular, it can be hooked into this household appliance component by these holding hooks 43 and 44. For example, the household appliance component can be a rear wall. It can be the rear wall of the inner liner 4. However, it can also be a rear wall separate from it.

As it is apparent in FIG. 2 and FIG. 3, this rear-side end piece 42 of the holding bracket 40 extends rearwards out of the housing 32. In this respect, the corresponding holding bracket 40 is shown in FIG. 2 and FIG. 3, which is arranged in the second side bar 18. The second side bar 18 is constructed corresponding to the first side bar 17 with respect to the housing 32 and thus the housing parts 33 and 34.

By the configuration of the housing parts 33 and 34, a tunnel-like or channel-like or scabbard-like housing 32 is also formed. By such a configuration, it is allowed that such an elongated, sword-like holding bracket 40 is introduced as extensively as possible. Thus, the holding bracket 40 is arranged at the carrier frame 16 circumferentially protected on the one hand. On the other hand, it can thereby also be arranged in mechanically improved manner. Thus, a more stable attachment of this separate holding bracket 40 to further components of the carrier frame 16 is in particular allowed. In an embodiment, it can be provided that the holding bracket 40 is positionally fixed to the housing parts 33 and/or 34. Thereto, a detent can be provided. In this context, the holding bracket 40 can then be arranged in the housing 32 in positionally fixed manner at least in depth direction. Couplers 45 and/or 46 can be provided as the detent. They are formed at the holding bracket 40, in particular the bracket part 41, in the embodiment. Counter couplers, which then engage with these couplers 45 and 46, can be formed at the housing part 33 and/or at the housing part 34.

In FIG. 4, it is also shown in an embodiment that the connection 35 for example comprises latches 47 in an embodiment. They are only symbolically illustrated in FIG. 4. Both the number and the position can be manifold in this respect. These latches 47 can snap-fit to further latches formed at the second housing part 34. Thereby, a snap-fit connection is formed. The latches 47 can be first latches in this context. Further latches can be formed at the second housing part 34 as second latches.

A mount for the holding bracket 40 is formed by the couplers 45 and 46 and the counter coupling elements 48. In this embodiment, counter couplers 48 can for example be provided at the first housing part 33. Here too, both the number and the position are definitely not to be understood in restricting or conclusive manner.

In an embodiment, the housing 32 comprises a top face 49. This top face 49 comprises a first top face section 50 in an embodiment. Moreover, it comprises a second top face section 51. The two top face sections 50 and 51 are extensive strips. They are oriented in series to each other in depth direction. The top face sections 50 and 51 are rectilinearly formed. The top face section 50 is formed consistently at a first level. The second top face section 51 is formed at a different level compared thereto. However, in an embodiment, the second top face section 51 is formed at a lower level than the first top face section 50. A step 52 is formed at a transition between the top face sections 50 and 51 adjoining to each other. It forms the offset at the junction between the two top face sections 50 and 51.

In an embodiment, the second shelf 13 is laid, in particular adhered, on the second top face section 51 from above.

Since the second side bar 18 is formed corresponding to the explanations to the first side bar 17 with respect to its configuration, the second shelf 13 is also laid, in particular adhered, on the corresponding top face section of the housing of the side bar 18.

In FIG. 4, an embodiment of the first guiding part 31*a* at the first side bar 17 is also shown. This guiding part 31*a* comprises a strip-shaped guiding lay-on 53. This guiding part 31*a*, as it is provided at the first side bar 17, is arranged exclusively at the second housing part 34 in the embodiment. It is in particular formed integrally with the second housing part 34.

In the mounted final state of the two housing parts 33 and 34, this strip-shaped guiding lay-on 53 is formed farther in the direction to the second side bar 18 viewed in width direction than the first housing part 33 extends in this respect. Thus, this strip-shaped guiding lay-on 53 extends farther in the direction to the second side bar 18 as also the top face 49 in width direction. Thereby, it is allowed that the shelf 9 only has to extend between the side bars 17 and 18 and can still be securely held and guided by laying on this strip-shaped guiding lay-on 53. By this width extension of the strip-shaped guiding lay-on 53, a guiding link open towards the top is thus virtually formed. Thus, there is no corresponding counterpart in the guiding 31, which would cover such a guiding link towards the top. Thus, the first shelf 9 is virtually exposed towards the top upon guiding on this strip-shaped guiding lay-on 53 viewed in the area without guiding pins 57*a*, 57*b*. It is not bounded or covered by a corresponding upper guiding lay-on opposing the strip-shaped guiding lay-on 53.

As is apparent in FIG. 4, this strip-shaped guiding lay-on 53 comprises a ramp 54 in addition to the strip-shaped base lay-on 53*a* in an embodiment. The first shelf 9 is continuously moved into a higher position by this ramp 54 upon shifting from its non-use position shown in FIG. 3 shortly before reaching the use position according to FIG. 2. Viewed in depth direction towards the front, this strip-shaped guiding lay-on 53 comprises a then again horizontal section 55. It adjoins to the ramp 54 on the front side. In the final position shown in FIG. 2 of the first shelf 9 in its use position, the first shelf 9 rests on this section 55 in particular with its front edge profile 12.

Figure 5:
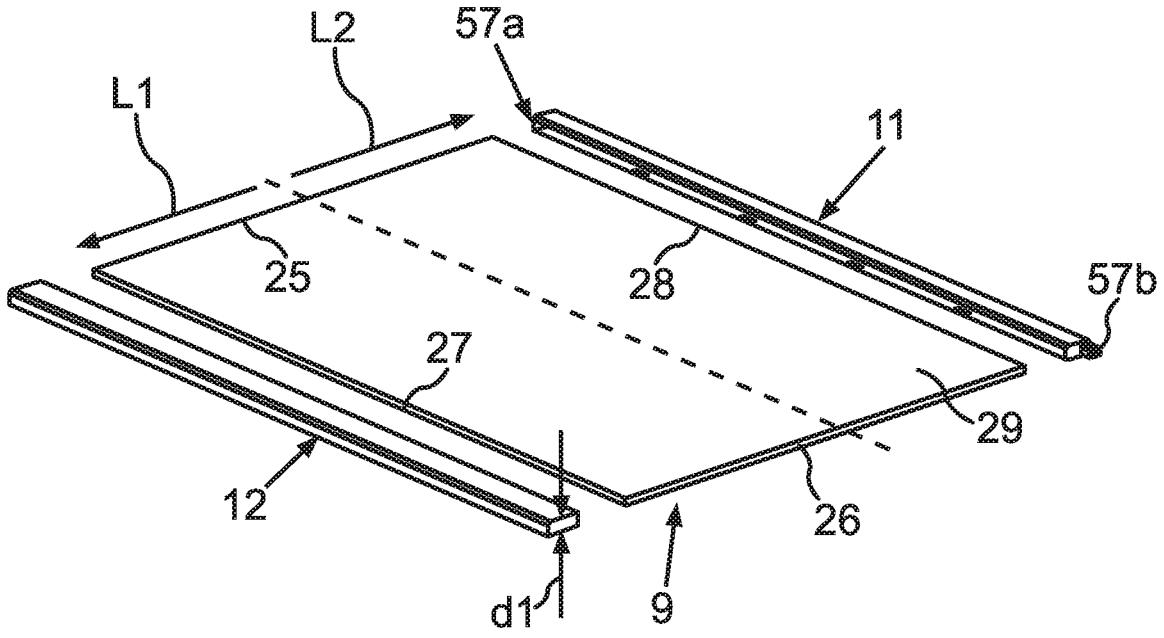
FIG. 5 is an exploded representation of an embodiment of a shelf of the shelf assembly according to FIG. 2 and FIG. 3.
Figure 6:
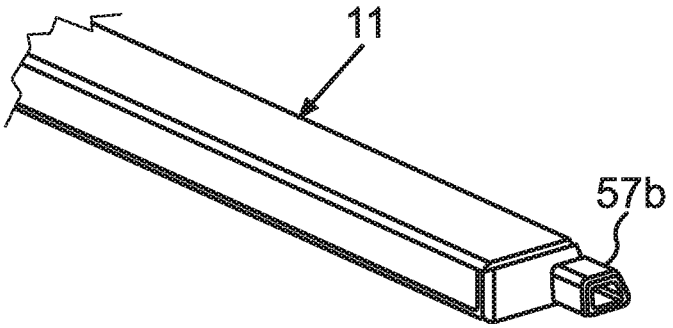
FIG. 6 is a perspective representation of a partial area of an edge profile of the shelf according to FIG. 5.

Moreover, the guiding 31 comprises a further ramp 56 at its guiding part 31*a*. This ramp 56 is narrower than the front ramp 54 viewed in width direction. The second ramp 56 is also narrower than this strip-shaped base lay-on 53*a*. A guiding pin 57*a* (FIG. 5 and FIG. 6) is guided on this further ramp 56. This guiding pin 57*a*, as it is shown in FIG. 5, is formed at the rear edge profile 11. It is laterally protruding beyond the base plate 10 in width direction.

In an embodiment, it is provided that only these two guiding pins 57*a* and 57*b* are provided. They are in particular formed integrally with the rear edge profile 11.

In an embodiment, the first shelf 9 does not comprise further laterally protruding guiding pins any more except for these two rear guiding pins 57*a* and 57*b*. Thus, it is provided in an embodiment that such guiding pins are not present in a front length half of the first shelf 9. The length of this first shelf 9 is measured in depth direction of the shelf assembly 8 in this context. Thus, this front edge profile 12 does not comprise such laterally protruding guiding pins in an embodiment. The base plate 10 also does not comprise such guiding pins. Thus, it is provided that the first shelf 9 is only coupled to two such guiding pins 57*a* and 57*b* of the guiding 31 in particular formed in a rear length half of the first shelf 9 and laterally protruding in an embodiment. Upon forward shifting the first shelf 9 starting from the non-use position in FIG. 3, these guiding pins 57*a* and 57*b* are guided in this guiding part 31*a* and there then brought into a final position. In this final position, the guiding pin 57*a* is introduced in a receiving core 58 shown in FIG. 4. The guiding pin 57*a* is then also held in this receiving core 58, which is a constituent of the first guiding part 31*a*. The receiving core 58 is arranged at a level, which corresponds to the level of the section 55. Thereby, the first shelf 9 is completely horizontally oriented in its use position according to FIG. 2.

The receiving core 58 is formed, in particular integrally formed, in the second housing part 34 in the shown embodiment. The receiving core 58 can also be referred to as receiving box or receiving recess.

In this respect too, the second side bar 18 is correspondingly formed. Thereby, the further guiding pin 57*b* can be correspondingly guided and positioned. The corresponding further ramp 56 is also formed there.

As is apparent in representations in FIG. 3 and FIG. 4, this strip-shaped guiding lay-on 53 is formed in front of the second shelf 13 viewed in depth direction. In an embodiment, this strip-shaped guiding lay-on extends over at least 90 percent in the direction of the measured length of the first shelf 9 in the use position. Thus, the shelf 9 is also completely laterally bordered by the housing 32 over its entire length in its use position according to FIG. 2.

Thus, a front area of the shelf 9 also rests on this strip-shaped guiding lay-on 53 in the use position of the first shelf 9. The ramp 54 and the section 55 are also associated with it. By this strip-shaped guiding lay-on 53, as it extends and geometrically forms, is also allowed that the first shelf 9 is simpler to handle with respect to its shift. A more jamming-free and strutting-free shift is allowed. In the front area of the first shelf 9, laterally protruding guiding pins are no longer required. In the use position according to FIG. 2, the shelf 9 is therefore also movable relative to the carrier frame 16 at least in the front area in an embodiment. In this respect, it can be easily lifted. Thereto, the guiding pins 57*a* and 57*b* form a rotational axis or pivot axis, around which the first shelf 9 can also be pivoted in the use position. In this respect, easy lifting can in particular be effected. Thereby, moving the first shelf 9 from its use position towards the non-use position according to FIG. 3 is also facilitated. The initiation this shifting process is also simplified by this configuration. Because, the first shelf 9 can first be easily lifted on the front side starting from the use position shown in FIG. 2 in this context. Thereby, the following shift of the first shelf 9 is simplified. Leading out the guiding pins 57*a* and 57*b* from the receiving core 58 is thereby facilitated.

Upon shifting the first shelf 9, this first shelf 9 rests on these strip-shaped guiding lay-ons 53. In an embodiment, this is effected by the front edge profile 12. It can also be provided that the base plate 10 additionally directly rests on this strip-shaped guiding lay-on 53.

In the surface area of this strip-shaped guiding lay-on 53, the first shelf 9 is arranged completely exposed towards the top and thus viewed in vertical direction. This means, as it was already explained above, that this strip-shaped guiding lay-on 53 does not comprise an overlying counterpart such that an upwards closed guiding groove is not formed. Upon shifting, a first length half L1 (FIG. 5) of the first shelf 9 is only guided by resting on this strip-shaped guiding lay-ons 53 of these two side bars 17 and 18. This front length half L1 does not comprise lateral guiding pins or the like as the rear length half L2 of the first shelf 9 comprises.

Moreover, the guiding 31 comprises a rear guiding section 59 in an embodiment. This rear guiding section 59, as it is illustrated at the side bar 17 in FIG. 4, is arranged below the second shelf 13 in vertical direction (y-direction) of the shelf assembly 8. Thereby, the first shelf 9 can be shifted below the second shelf 13 also guided in this respect. The rear guiding section 59 directly adjoins to the guiding lay-on 53. The rear guiding section 59 is a constituent of the first guiding part 31*a*.

In an embodiment, it is provided that the first shelf 9 can be rearwards shifted out of the carrier frame 16 in depth direction of the shelf assembly 8. Thus, for example starting from the non-use position of the first shelf 9 in FIG. 3, this first shelf 9 can be rearwards shifted out of the carrier frame 16. Thereby, it can also be completely removed from the carrier frame 16. Thereby, the cleanability of the first shelf 9 is for example separately possible. Improved cleaning of this component is thereby allowed.

Figure 7:
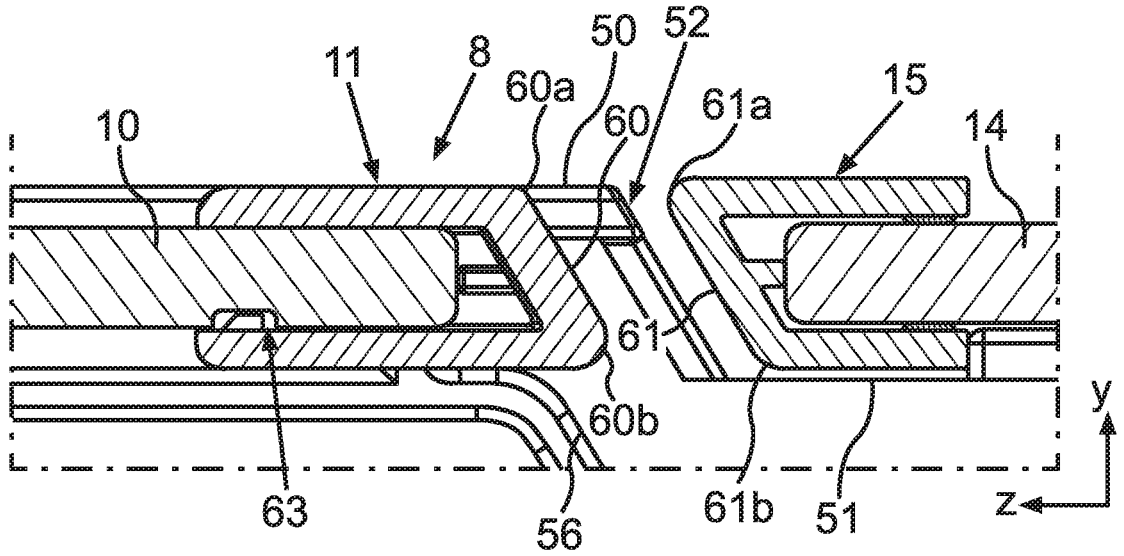
FIG. 7 is a sectional representation through a partial area of the shelf assembly in the use position according to FIG. 2.

In FIG. 7, a partial section of the shelf assembly 8 according to FIG. 2 is shown in a vertical sectional representation. Here, the sectional plane is the y-z plane. As is apparent, the rear edge profile 11 comprises a rear wall 60. This rear wall 60 is obliquely oriented. An upper end 60*a* of this rear wall 60 is farther forward than a lower end 60*b* viewed in depth direction. In an embodiment, it is provided that a front wall 61 of the front edge profile 15 is obliquely inclined. In an embodiment, an upper end 61*a* of this front wall 61 is positioned farther forward viewed in depth direction than a lower end 61*b*. As is apparent in FIG. 7, the rear wall 60 and the front wall 61 are inclined in the same direction. In an embodiment, a distance between this rear wall 60 and the front wall 61 is set in the use position. Thus, a crack 62 is formed. It can be configured relatively small in this respect. If such an inclined position of the rear wall 60 and/or the front wall 61 would not be formed, the crack 62 would be considerably larger measured in depth direction. This would be disadvantageous with regard to falling-through of storage parts or the like. By this specific geometry of the rear wall 60 and/or the front wall 61 and thus the shaping of the crack 62 resulting from it, an improved concept can be provided in this respect. By this crack 62, a specific venting slit can then also be formed. The passage of the air can also be effected preset in a certain orientation to some extent by this specific inclination.

In an embodiment, it is provided that the rear edge profile 11 is attached to the base plate 10 by a snap-fit connection 63. In an embodiment, it can be provided that the front edge profile 15 is attached to the base plate 14 by a corresponding snap-fit connection.

Figure 8:
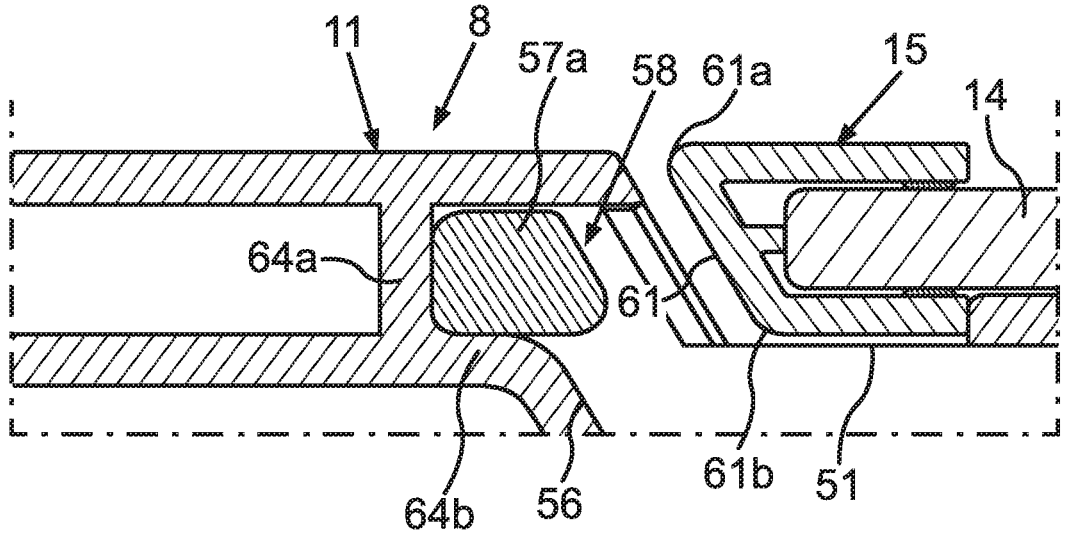
FIG. 8 is a sectional representation according to FIG. 7 in a sectional plane parallel thereto.

In FIG. 8, the arrangement of the components according to FIG. 7 is shown in a corresponding vertical sectional representation. However, a vertical sectional plane different from FIG. 7 is chosen in FIG. 8. It is parallel to FIG. 7. In FIG. 8, a vertical sectional representation through the guiding pin 57*a* is shown in this respect. The receiving core 58 is also shown in FIG. 8. The receiving core 58 is bounded towards the front by a front wall 64*a*. A stop for the guiding pin 57*a* is formed by the front wall 64*a*. In an embodiment, the receiving core 58 is bounded towards the bottom by a base wall 64*b*. The guiding pin 57*a* rests on this base wall 64*b* in its final position when it is introduced in the receiving core 58.

Figure 9:
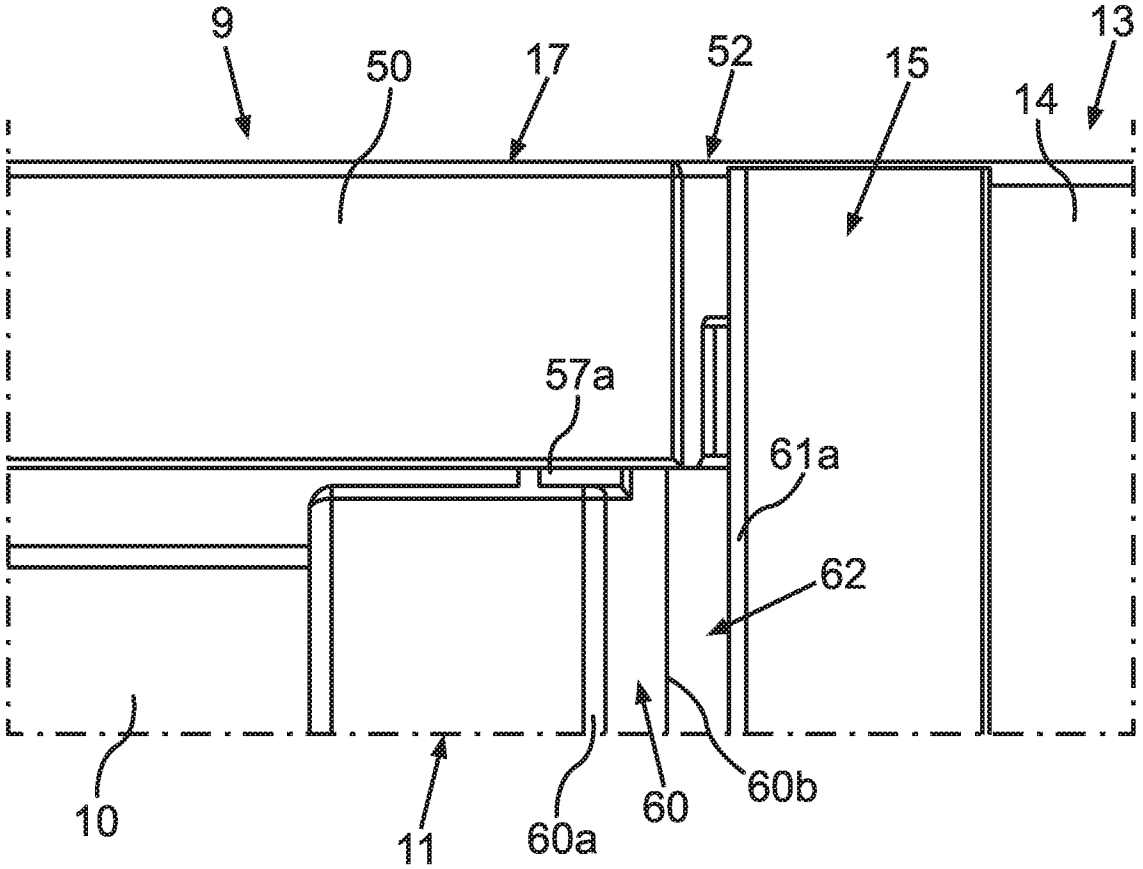
FIG. 9 is a plan view to a partial area of a shelf assembly according to FIG. 2.

In FIG. 9, a representation of a partial section of the shelf assembly 8 according to FIG. 2 is shown in a plan view.

Figure 10:
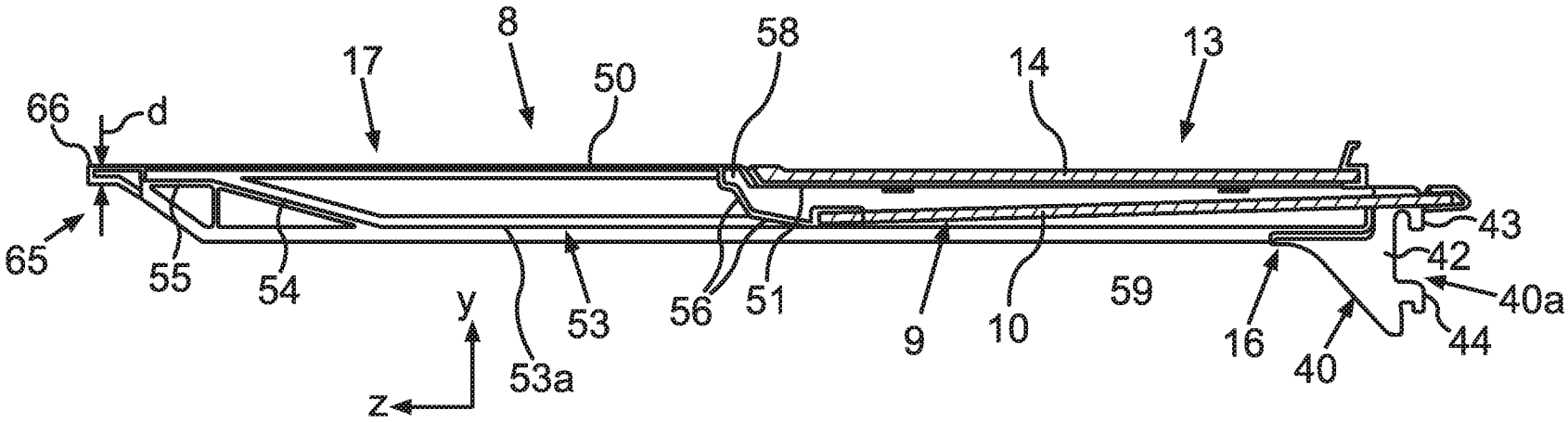
FIG. 10 is a sectional representation through the shelf assembly according to FIG. 2 and FIG. 3, wherein a movable shelf of this shelf assembly is rearwards guided out of a carrier frame of the shelf assembly in certain areas in the representation according to FIG. 10.

In FIG. 10, the shelf assembly 8 is shown in a further vertical sectional representation. In contrast to the representation in FIG. 3, in which the non-use position of the shelf 9 is illustrated, this shelf is already shifted out of the carrier frame 16 slightly further to the rear in FIG. 10. In this context, FIG. 10 shows the possibility already set forth above of completely rearwards removing the shelf 9 out of the carrier frame 16.

Moreover, a front end 65 of the first side bar 17 of the carrier frame 16 is shown in FIG. 10 as already apparent in FIG. 3 and FIG. 4 as well as also in FIG. 2. The front end 65 is formed tapered. The front end 65 comprises a neck 66 protruding to the front. This neck 66 has a thickness d. In an embodiment, this thickness d corresponds to the thickness d1 (FIG. 5) of the first shelf 9. In an embodiment, the thickness d1 is the thickness of the front edge profile 12. Here too, it is provided in corresponding configuration that the second side bar 18 is also correspondingly configured.

In conclusion, it is to be mentioned again that the configuration of the side bar 17, as was explained above and amplified based on embodiments, can each be correspondingly provided for the second side bar 18 in an embodiment.

In an embodiment the housing is formed as a rectilinear scabbard.

In an embodiment the housing comprises a first housing part and a second housing part separate from it, wherein the housing parts are connected by a connection.

In an embodiment the connection is a snap-fit connection.

In an embodiment the snap-fit connection comprises a first latch, which is arranged at the first housing part, and comprises a second latch, which is arranged at the second housing part, wherein the first latch and the second latch are snap-fitted when the housing parts are connected.

In an embodiment the shelf assembly has a width direction, and the carrier frame comprises a second side bar, wherein the second side bar is arranged parallel to the first side bar, wherein the second elongated housing part is arranged closer to the second side bar than the first elongated housing part in this width direction, wherein the guiding comprises a first guiding part and the second housing part comprises an outer side, wherein the first guiding part is integrated on the outer side of the second housing part.

In an embodiment the shelf assembly has a depth direction, wherein the first side bar extends in this depth direction, wherein the housing comprises a rear end, and the rear end comprises an opening, wherein the holding bracket comprises a rear end, which protrudes out of the opening to the rear.

In an embodiment the housing comprises at least one mount, by which the introduced holding bracket is arranged in the housing secured in its position in depth direction of the shelf assembly.

In an embodiment the housing comprises a top face, and the top face comprises a first top face section and a second top face section, wherein the top face sections are arranged at different levels and directly adjoin to each other and the junction is a step.

In an embodiment the second shelf rests on the second top face section.

In an embodiment the second shelf is adhered to the second top face section.

In an embodiment the first shelf comprises a guiding pin, which engages with the guiding, wherein the guiding comprises a receiving core, in which the guiding pin is introduced when the first shelf is arranged in a use position, wherein the first shelf is arranged completely in front of the second shelf in depth direction of the shelf assembly in this use position.

In an embodiment the housing comprises a front end, wherein the front end is closed and tapered.

In an embodiment the front end comprises a neck protruding to the front, which has a thickness, which corresponds to the thickness of a front border of the first shelf.

The following is a list of reference numerals used in the above description of the invention with reference to the drawing figures:

1 household cooling appliance
2 housing
3 outer housing
4 inner liner
5 receiving space
6 clearance
7 door
8 shelf assembly
9 first shelf
10 base plate
11 rear edge profile
12 front edge profile
13 second shelf
14 base plate
15 front edge profile
16 carrier frame
17 side bar
18 side bar
19 connecting bar
20 front edge
21 side edge
22 side edge
23 rear edge
24 free space
25 side edge
26 side edge
27 front edge
28 rear edge
29 top face
30 top face
31 guiding
**31*a*** guiding part
32 housing
33 first housing part
34 second housing part
**34*a*** outer side
35 connection
36 front end
37 rear end
38 opening
39 hollow space
**40*a*** rear end
40 holding bracket
41 bracket part
42 end piece
43 holding hook
44 holding hook
45 coupler
46 coupler
47 latch
48 counter coupler
49 top face
50 first top face section
51 second top face section
52 step
53 guiding lay-on
**53*a*** base lay-on
54 ramp
55 section
56 ramp
57 guiding border
**57*a*** guiding pin
**57*b*** guiding pin
58 receiving core
59 rear guiding section
60 rear wall
**60*a*** upper end
**60*b*** lower end
61 front wall
**61*a*** upper end
**61*b*** lower end
62 crack
63 snap-fit connection
**64*a*** front wall
**64*b*** base wall
65 front end
66 neck
A axis B length axis
L1 first length half
L2 second length half
d thickness
d1 thickness
x width direction
y vertical direction
z depth direction

The invention claimed is:

1. A shelf assembly for installation in a household cooling appliance, the shelf assembly comprising:
a first shelf;
a second shelf, which is separate from said first shelf;
a carrier frame supporting said first shelf and said second shelf;
said carrier frame including a guiding configured to enable at least one of said first and second shelves to be shifted relative to said carrier frame and to the other of said first and second shelves;
said carrier frame including a first side bar, said first side bar having a holding bracket configured for holding the shelf assembly at a household cooling appliance component and said first side bar including a channel housing, into which said holding bracket is introduced; and
said channel housing including a first housing part and a second housing part separate from said first housing part, and a connection connecting said first and second housing parts.

2. The shelf assembly according to claim 1, wherein
said channel housing is formed as a rectilinear scabbard.

3. The shelf assembly according to claim 1, wherein said connection is a snap-fit connection.

4. The shelf assembly according to claim 3, wherein said snap-fit connection comprises a first latch, which is arranged at said first housing part, and a second latch, which is arranged at said second housing part, and wherein said first latch and said second latch are snap-fitted when said first and second housing parts are connected.

5. The shelf assembly according to claim 1, wherein said carrier frame comprises a second side bar arranged parallel to said first side bar, wherein said second housing part is an elongated housing part arranged closer to said second side bar than said first elongated housing part in a width direction of the shelf assembly, and wherein said guiding comprises a first guiding part and said second housing part comprises an outer side, with said first guiding part being integrated on an outer side of said second housing part.

6. The shelf assembly according to claim 1, wherein said first side bar extends in a depth direction of the shelf assembly, wherein said channel housing comprises a rear end, and said rear end comprises an opening, wherein said holding bracket comprises a rear end, which protrudes out of said opening to the rear.

7. The shelf assembly according to claim 1, wherein said channel housing comprises at least one mount, by which the introduced holding bracket is arranged in said housing secured in its position in a depth direction of the shelf assembly.

8. The shelf assembly according to claim 1, wherein said channel housing has a top face with a first top face section and a second top face section, wherein said first and second top face sections are arranged at different levels and directly adjoin each other across a junction being a step.

9. The shelf assembly according to claim 8, wherein said second shelf rests on said second top face section.

10. The shelf assembly according to claim 9, wherein said second shelf is adhered to said second top face section.

11. The shelf assembly according to claim 1, wherein said first shelf comprises a guiding pin, which engages with said guiding, wherein said guiding comprises a receiving core, in which said guiding pin is introduced when said first shelf is arranged in a use position, and wherein said first shelf is arranged completely in front of said second shelf in a depth direction of the shelf assembly in the use position.

12. The shelf assembly according to claim 1, wherein said channel housing comprises a closed and tapered front end.

13. The shelf assembly according to claim 12, wherein said front end comprises a neck protruding to the front, which has a thickness, which corresponds to the thickness of a front border of said first shelf.

14. A household cooling appliance, comprising:
a housing formed with a receiving space for food in said housing;
a shelf assembly arranged in said receiving space, said shelf assembly including:
a first shelf and a second shelf separate from said first shelf;
a carrier frame supporting said first shelf and said second shelf;
said carrier frame having a guiding configured to enable at least one of said first and second shelves to be shifted relative to said carrier frame and to the other of said first and second shelves; and
said carrier frame having a first side bar with a holding bracket for holding the shelf assembly at a component of the household cooling appliance and said first side bar including a channel-shaped housing, into which said holding bracket is introduced; and
said channel-shaped housing having a first housing part and a second housing part separate from said first housing part, and a connection connecting said first and second housing parts.

* * * * *